United States Patent [19]

Kritske

[11] 4,278,032

[45] Jul. 14, 1981

[54] TWO DIRECTION BRAKE FOR A DRAFTING TABLE

[75] Inventor: Victor J. Kritske, Sheboygan, Wis.

[73] Assignee: Mayline Co., Inc., Sheboygan, Wis.

[21] Appl. No.: 44,930

[22] Filed: Jun. 4, 1979

[51] Int. Cl.[3] ..... A47B 27/18

[52] U.S. Cl. ..... 108/6; 74/531; 188/69; 188/77 W; 188/82.6; 192/8 C; 248/166; 312/231

[58] Field of Search ..... 74/531, 534, 470, 501 R, 74/504, DIG. 2; 188/77 W, 69, 82.6; 192/8 C; 248/166, 170; 108/6; 312/231

[56] References Cited

U.S. PATENT DOCUMENTS

| | | | |
|---|---|---|---|
| 3,028,933 | 4/1962 | Mueller | 188/77 W |
| 3,064,766 | 11/1962 | Hanizeski | 188/77 W |
| 3,135,369 | 6/1964 | Nisenson et al. | 74/531 X |
| 3,153,370 | 10/1964 | Heimall | 188/77 W X |
| 3,206,268 | 9/1965 | Grow et al. | 312/231 |
| 3,249,180 | 5/1966 | Torossian | 74/531 X |
| 3,528,533 | 9/1970 | Sacchini | 188/77 W X |
| 3,633,964 | 1/1972 | Bertin | 74/531 X |
| 3,874,480 | 4/1975 | Porter et al. | 74/531 X |

*Primary Examiner*—C. J. Husar
*Assistant Examiner*—Moshe I. Cohen
*Attorney, Agent, or Firm*—Irwin C. Alter

[57] ABSTRACT

Drafting board apparatus features a dual-spring brake to enable the angle of tilt of the drafting board to be selectively altered. Use of oppositely-coiled springs secures the board against movement, while a control linkage enables near-simultaneous release of said springs to enable adjustment of the board.

10 Claims, 6 Drawing Figures

TWO DIRECTION BRAKE FOR A DRAFTING TABLE

This invention relates generally to equipment and accessories used in mechanical drawing, and more particularly, to a drafting board assembly including structure enabling positive and convenient tilting of the drawing surface through a wide range of angular adjustment.

One of the most important requirements for the production of accurate mechanical drawings is a work surface upon which the actual drawing may be performed. Very often, work on mechanical drawings extends over long hours, and it is therefore important that the work surface used be not only flat, smooth, and well lighted, but that it also be adjustable to whatever angle of tilt the individual draftsman determines to be the most comfortable.

Frequently, it is desirable to adjust and readjust the angle of tilt of the drafting surface several times while working on the same drawing. Prior art devices have, for the most part, been manufactured with a single preset tilt angle, or have required awkward and time-consuming operations in order to change the tilt angle of the drawing surface making it very difficult and inconvenient for the draftsman to adjust his board.

As an example, the student drafting table, one variation of which is illustrated in U.S. Pat. No. 3,206,268, includes a lower cabinet portion to which the drawing board is hinged. Adjustment of the angle of tilt is typically accomplished by loosening a knob which will then allow the drafting surface to rotate about the hinge. Often, however, this rotation is awkward and difficult to control because releasing the knob mechanism completely releases the drafting board, and it will rotate of its own weight unless physically restrained.

Whatever the means selected to adjust the drafting board, adjustment is often further hampered by the placing of the adjusting means in a difficult to reach location. Often, the draftsman is required to grope beneath or behind the board surface, and must hold the board while operating the adjusting mechanism.

Other known adjusting mechanisms require tightening or loosening of elements at more than one location, further complicating board adjustment.

Accordingly, the present invention has the following objects:

To provide drawing board mechanisms with drawing surfaces freely adjustable through a wide range of tilt angles;

To provide such apparatus with adjusting mechanisms which are simple and convenient to operate;

To provide such apparatus in forms which are reliable in use and economical to manufacture;

To provide such mechanisms in forms releasable and engagable by a single control element.

These and further objects will become more apparent upon consideration of the accompanying drawings, wherein.

Figure 1:
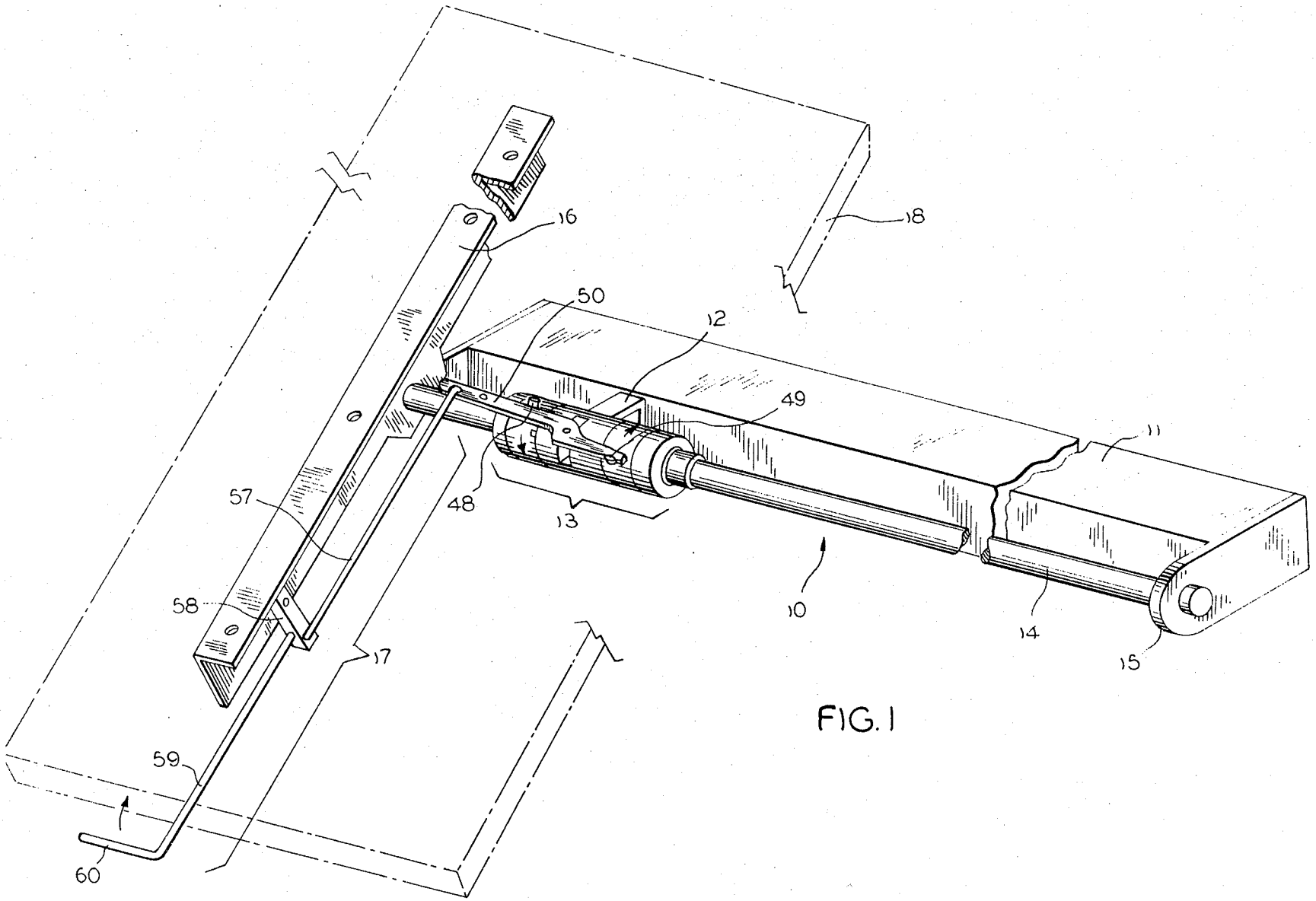
FIG. 1 is a perspective view of a drafting board positioning assembly embodying the present invention.

Referring now to FIG. 1, the numeral 10 indicates generally a drafting board assembly including a support channel 11, which may be attached to a flat surface, such as a cabinet top, or which may be supported by a floor contacting sub-structure (not herein shown).

Channel bracket 12 is attached to support channel 11 as, for example, by spot welding, and supports brake assembly 13. Board shaft 14 is rotatably supported by support channel 11 as, for example, at ear 15 through which shaft 14 may be journaled, and passes through brake assembly 13. Board bracket 16 is integrally affixed to shaft 14 such that when shaft 14 is rotated, board bracket 16 is also rotated.

Rotation of shaft 14 and board bracket 16 is effected by brake assembly 13, actuated by control assembly 17, in a manner to be set forth hereinbelow. Drafting board 18, herein illustrated in phantom, is attached to board bracket 16 in any conventional manner found to be convenient, and may thus be adjusted for tilt by the actuation of brake assembly 13 to release shaft 14, and the consequent rotation of shaft 14.

Figure 5:
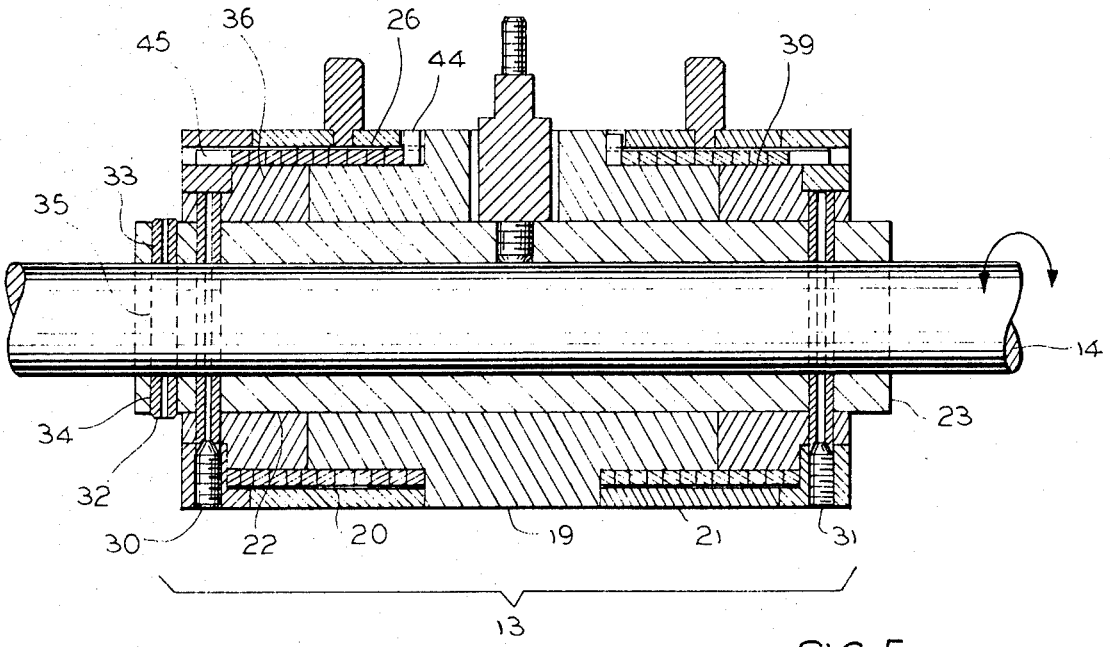
FIG. 5 is a view along 5—5 of FIG. 3.
Figure 6:
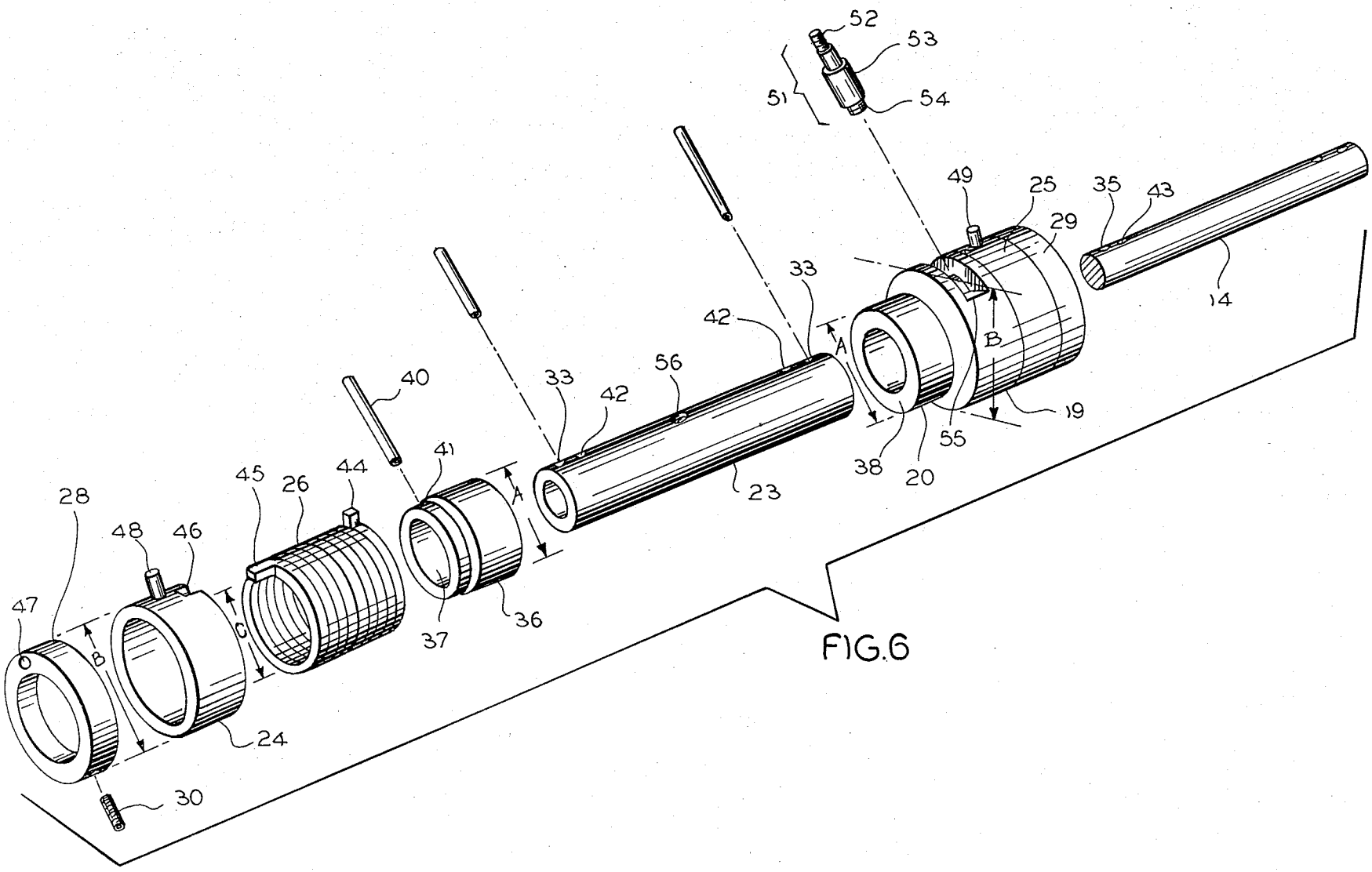
FIG. 6 is an exploded perspective view of the brake assembly.

Brake assembly 13 includes a central hub 19 which is non-rotatably attached to support channel 11 at channel bracket 12, as illustrated in FIG. 1. As best seen in FIGS. 5 and 6, hub 19 has shoulders 20 and 21 formed circumferentially thereabout, and has a central channel 22 formed axially therethrough, of sufficient diameter to accommodate bearing sleeve 23 rotatably therewithin. Bearing sleeve 23 is mounted to shaft 14 by, for example, retaining pins 32, as seen in FIGS. 5 and 6. Retaining pins 32 are passed through bearing sleeve 23 through registered apertures 33 and 34 formed in bearing sleeve 23, and aperture 35 formed through shaft 14, to secure shaft 14 and bearing sleeve 23 in rotational relationship.

Brake assembly 13 further includes rotatable outer drums 24 and 25 and brake springs 26 and 27, with drum 24 and brake spring 26 mounted coaxially on hub 19 to surround hub shoulder 20, and drum 25 and brake spring 27 similarly positioned to surround shoulder 21. Drum 24 is retained on brake assembly 13 by end cap 28. In like manner, drum 25 is retained by end cap 29. As shown in FIG. 5, end caps 28 and 29 may, in turn, be retained in position by set screws 30 and 31, respectively.

As best seen in FIGS. 5 and 6, brake collar 36 has central aperture 37 formed therethrough, sized to enable collar 36 to fit onto bearing sleeve 23 and to be positioned within drum 24. The outside diameter A of brake collar 36 is substantially identical to the outside diameter B of shoulder 20 of hub 19, and when brake assembly 13 is assembled, brake collar 36 is positioned coaxial with and proximate to face 38 of shoulder 20. In like manner, brake collar 39 is also sized, shaped, and positioned, as illustrated in FIG. 5.

Collar pin 40 is passed through collar aperture 41 registered with sleeve aperture 42 and shaft aperture 43 in order to lock brake collar 36 into rotational cooperation with bearing sleeve 23 and shaft 14. Brake collar 39 is assembled in like manner to the remaining side of brake assembly 13.

Brake spring 26 is a helical spring preferably fashioned from flat coiled spring steel, with a normal, unstressed inside diameter C, as shown in FIG. 6, which is less than the outside diameter A of brake collar 36 and outside diameter A of hub shoulder 20. In a preferred embodiment of the present invention, brake spring 26 has a radially outwardly extending lug 44 formed at one end thereof, and an axially outwardly extending lug 45 formed at the remaining end thereof. It is contemplated that brake spring 26 may be stressed by fixedly restraining one said lug while rotating the other of said lugs in a direction opposite to that direction in which brake spring 26 is coiled. Thus, stressing brake spring 26 will increase inside diameter C of said spring coil, while releasing said stress will cause brake spring 26 to attempt to resiliently regain its original minimum inside diameter.

In a preferred embodiment of the present invention, radial lug 44 is retained within drum slot 46, formed in drum 24, while axial lug 45 is retained within end cap aperture 47, formed through end cap 28.

As best seen in FIG. 5, when brake assembly 13 is assembled, brake spring 26 overlaps both shoulder 20 and brake collar 36. As hereinabove described, the normal unstressed inside diameter of brake spring 26 is less than the outside diameters of hub shoulder 20 and brake collar 36. Therefore, in order to fit brake spring 26 over clutch collar 36 and hub shoulder 20, said brake spring must first be partially stressed. When said stress is removed, brake spring 26 will grip hub shoulder 20 and brake collar 36 as it attempts to regain its smaller, unstressed configurations. The compression of brake spring 26 is selected to be sufficient to prevent relative rotational movement of brake collar 36 with respect to hub shoulder 20. As seen in FIG. 5, brake spring 27 is positioned, shaped, assembled and retained within brake assembly 13 in like manner as hereinabove described.

As hereinabove described, end cap 28 is rotationally associated with brake collar 36 by set screw 30 which, when tightened, contacts brake collar 36. Drum 24, however, may rotate freely with respect to end cap 28, and such rotation is effected by exerting a force against drum pin 48.

As drum 24 is rotated, however, stress is applied to brake spring 26 by reason of the restraint of axial lug 45 in end cap aperture 47, and the positioning of radial lug 44 in drum slot 46. Thus, as drum 24 is rotated in a direction opposite to the direction in which brake spring 26 is coiled, brake spring 26 will eventually release its restraining grip upon brake collar 36 and hub shoulder 20, allowing brake collar 36 to rotate with respect to hub 19. As brake collar 36 is fixedly restrained to bearing sleeve 23 and shaft 14, as is end cap 28, the entire brake assembly will rotate with brake collar 36 except for hub 19.

It is to be understood, however, that for such rotation to take place, both clutch spring 26 and brake spring 27 must be released from their respective engagements with brake collar 36 and hub shoulder 20, and brake collar 39 and hub shoulder 21. Such release is most conveniently accomplished when both brake springs 26 and 27 are released nearly simultaneously.

Figure 2:
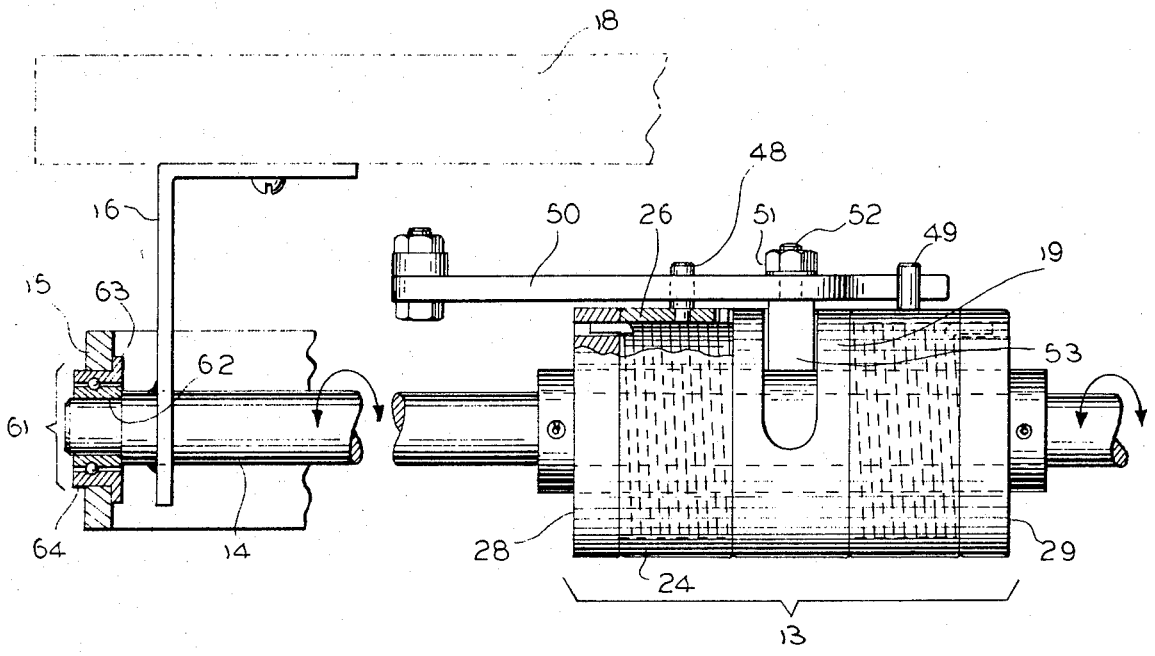
FIG. 2 is a front view of the apparatus shown in FIG. 1.

To accomplish such near-simultaneous release, control assembly 17 is provided which includes control arm 50, best seen in FIGS. 1 and 2, pivotally mounted to brake assembly 13 and shaped to contact drum pins 48 and 49.

Mounting control arm 50 to brake assembly 13 is preferably accomplished by use of arm mount 51, having an upper threaded portion 52, a central body 53, and a lower threaded portion 54. A circumferentially extending slot or window 55 may be formed through hub 19, as best seen in FIG. 6, and arm mount 51 may be threaded into tapped sleeve aperture 56 on sleeve 23 through window 55. Control arm 50 may then be pivotally mounted to upper threaded portion 52 of arm mount 51. In this manner, the maximum rotational movement impartable to shaft 14 may be limited by selecting the size of window 55. As body portion 53 of arm mount 51 reaches the end of window 55, no further relative movement of bearing sleeve 23 with respect to hub 19 is possible.

In the above-discussed preferred embodiment, simultaneous gripping and releasing of brake springs 26 and 27 is accomplished where said springs are coiled in opposite directions. Thus, for example, as drum 25 is moved clockwise and drum 24 is moved anti-clockwise by control arm 50, both brake springs 26 and 27 will be released. Any force which would tend to rotate shaft 14 will result in rotational force being exerted by brake collars 36 and 39 on clutch springs 26 and 27, respectively. Where, as here, such brake springs are oppositely coiled, the force exerted by one said brake collar will be in a direction *opposite* to that required to uncoil one said spring. This apparently provides an added holding force to prevent unwanted rotation, and to hold board 18 even more firmly at a selected angle of tilt.

Figure 3:
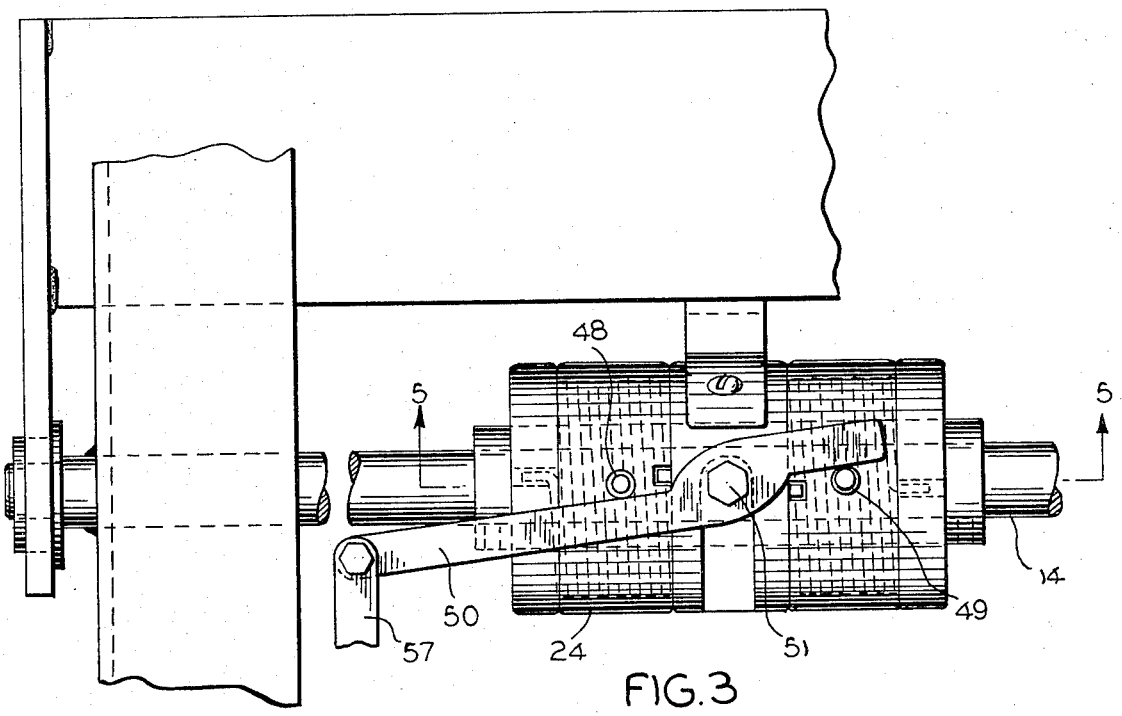
FIG. 3 is a top view of the apparatus in FIG. 1 shown in an engaged attitude.
Figure 4:
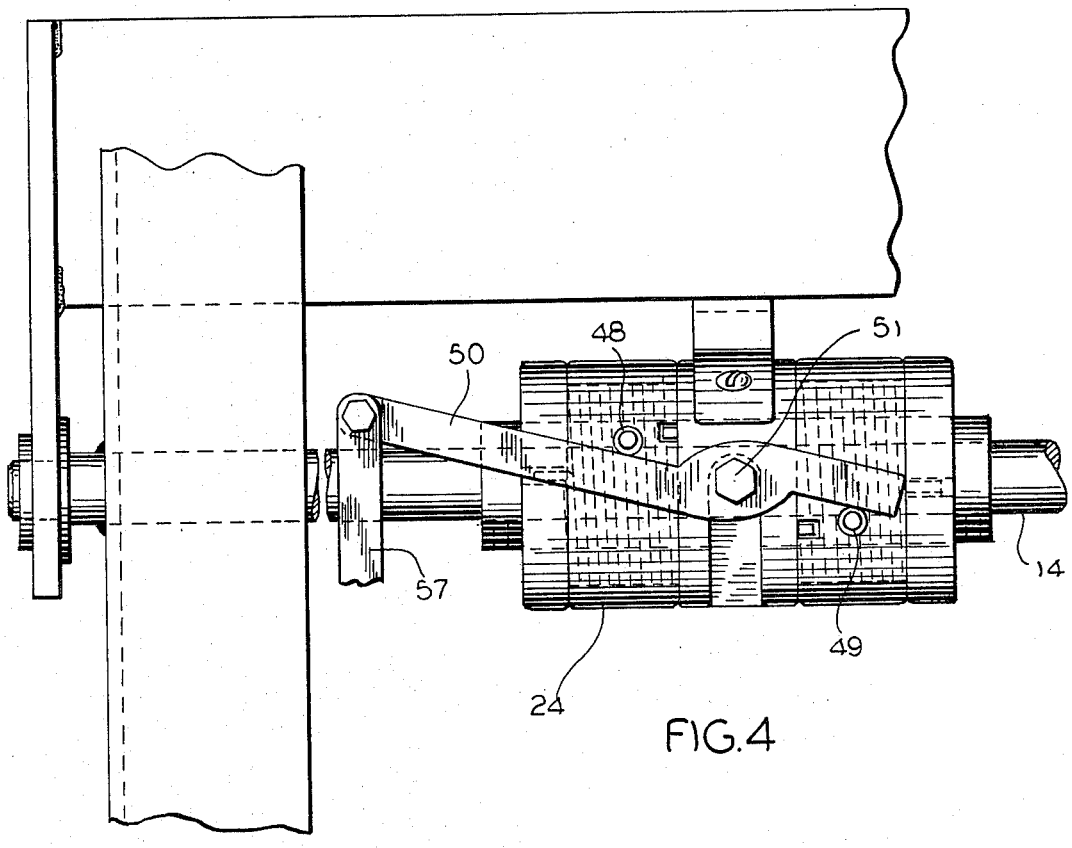
FIG. 4 is the same view as in FIG. 3 showing the mechanism in a released attitude.

A convenient means to rotate control arm 50 is seen in FIG. 1 where upper linkage 57, pivot block 58, and lower linkage 59 may be attached such that pushing lower linkage 59 via handle 60 will place brake assembly 13 in a released or rotatable attitude, as illustrated in FIG. 3, while releasing handle 60 will enable brake springs 26 and 27 to return clutch assembly 13 to a locked or stationary attitude as illustrated in FIG. 4.

Use of the present invention may be conveniently described as follows. Drawing board support assembly 10 is secured to a selected support under-structure, which may be, for example, a countertop, a set of legs, an easel, or the like. A drawing board 18 may then be attached to board bracket 16, as, for example, by drilling holes in the underside of drawing board 18 and using threaded fasteners to secure said board to board bracket 16, as shown in FIG. 2. Though herein depicted as a single bracket, it is to be understood that any number of board brackets 16 may be mounted to board shaft 14 in order to accommodate drawing boards of various sizes and weights.

As best seen in FIG. 2, board bracket 16 is fixedly attached to shaft 14 as, for example, by welding. Thus, bracket 16 will move responsive to the rotation of shaft 14.

To adjust board 18 to a selected angle of tilt, handle 60 is operated to move control arm 50, via linkages 57 and 59, to contact drum pins 48 and 49 to thereby rotate drums 24 and 25 with respect to, respectively, end caps 28 and 29. Such rotation stresses brake springs 26 and 27 with sufficient force to release brake collars 36 and 39 to enable brake collars 36 and 39, bearing sleeve 23, and shaft 14, to rotate with respect to hub 19, thereby enabling the angle of tilt of board 18 to be altered, as desired.

The range through which board 18 may be tilted may be effectively limited by choosing the size of window 55 within which arm mount 51 travels during rotation. Arm mount 51 thereby acts as both a mount for control arm 50, and as a stop.

As handle 60 is gradually moved to contact drum pins 48 and 49, and as drums 24 and 25 rotate, stress is gradually applied to brake springs 26 and 27. Such stress, applied progressively, causes brake springs 26 and 27 to uncoil, thus lessening the grip of said springs until a point is reached at which collars 36 and 39, and shaft 14 may be rotated. By operating handle 60 to modulate the amount of stress placed upon brake springs 26 and 27, the user may control the amount of force needed to adjust board 18; brake 13 not only controls rotation of shaft 14, but may be used to damp such rotation as well.

As best seen in FIG. 2, shaft 14 may be mounted within bracket ear 15 using bearing assembly 61 to facilitate rotation. Said assembly, in this embodiment, includes an inner collar 62, an outer collar 63, and roller bearings 64 disposed therebetween.

The force necessary to rotate sleeve 23 within hub 19, when brake assembly 13 is released, may be utilized to "damp" the tilting of board 18, such that, under normal load conditions, releasing brake assembly 13 will not cause board 18 to move of its own weight.

While the foregoing has presented a preferred embodiment of the present invention, it is to be understood that this embodiment is presented by way of example only, and is not intended to limit the invention described and claimed herein. It is expected that others skilled in the art will perceive variations which, although differing from the foregoing, do not depart from the spirit and scope of the invention as herein described and claimed.

I claim:

1. Brake apparatus of the type adjustably maintaining a shaft in a selected attitude of rotation, said apparatus comprising:

a stationary central hub, said stationary hub surrounding said shaft in rotatable relation thereto, said stationary hub having a first end and a second end as viewed along the axis of said shaft;

means positioned proximate said first hub end and said second hub end to retain said hub and said shaft in a selectable non-rotatable relation;

means to selectively control the release of said retaining means;

said control means rotating when said shaft is rotated; and means to limit the rotation of said shaft with respect to said stationary hub.

2. The apparatus as recited in claim 1 wherein said retaining means includes a first rotatable collar and a second rotatable collar, said first rotatable collar attached to said shaft proximate said first hub end, said shaft and said collar rotatable as a unit with respect to said hub, said second rotatable collar attached to said shaft proximate said second hub end, said shaft and said collar rotatable as a unit with respect to said hub, said first collar and said first hub end being of substantially identical diameter, said second collar and said second hub end being of substantially identical diameter; and first means to overlap and grip said second collar and said second hub end, second means to overlap and grip said first collar and first hub end, said first and said second gripping means being progressively releasable to enable relative rotation of said collars, and thereby said shaft, with respect to said stationary hub.

3. The apparatus as recited in claim 2 wherein said gripping means includes:

first and second spring coils, each said spring having a first end and a second end, said first and second spring coils positioned to respectively overlap and grip said first and second collars and said first and second hub ends.

4. The apparatus as recited in claim 2 wherein said control means includes:

a pair of drums, one said drum rotatably overlapping each said gripping means, each said drum including means to engage one said gripping means whereby said drum may be rotated to partially release said gripping means; and means to simultaneously rotate said drums to partially release said gripping means.

5. The apparatus as recited in claim 4 wherein said control means further includes:

each said drum having an upstanding peg formed thereon, a link arm having a first and second end;

said link arm rotatably mounted proximate said stationary hub and intermediate said drums, an arm mount having a first end and a second end;

said link arm being pivotally attached to said first end of said arm mount; and said second end of said arm mount adapted to rotate with said shaft.

6. The apparatus as recited in claim 5 wherein:

said link arm contacts one said peg at its first end, said link arm contacts the remaining said peg intermediate said first and second ends, and said control arm is linearly movable to rotate said drums to contact said pegs thereby partially releasing said gripping means and allowing said shaft to rotate with respect to said stationary hub.

7. The apparatus as recited in claim 1 wherein said limiting means includes:

said stationary hub having a slot formed therethrough, said slot in said stationary hub having a first and a second end, stop means protruding through said slot, said stop means rotating with said shaft to contact said stationary hub at said first slot end to limit rotation in a first direction, and at said second slot end to limit rotation in a second direction.

8. The apparatus as recited in claim 7 wherein said stop means comprises:

a bearing sleeve interposed between said stationary hub and said shaft, a bearing sleeve surrounding and firmly attached to said shaft, an arm mount having a first and second ends;

a link arm;

said first end of said arm mount having pivotally attached to it a portion of said link arm, said second end of said arm mount attached to said bearing sleeve, said arm mount protruding through said slot in said stationary hub, said arm mount, bearing sleeve and shaft rotatable as a unit until contact is made with said first or second ends of said slot.

9. Brake apparatus of the type adjustably maintaining a shaft in a selected attitude of rotation, said apparatus comprising:

a stationary central hub,
said stationary central hub having a slot formed therethrough,
said stationary hub surrounding said shaft,
said shaft rotatable with respect to said stationary hub,
said stationary hub having a first end and a second end as viewed along the axis of said shaft;
said shaft having a first end and a second end as viewed along the axis of said shaft;
a first rotatable collar and a second rotatable collar extending about the periphery of said shaft,
said first rotatable collar affixed to said shaft proximate said first hub end,
said shaft and said collar rotatable as a unit with respect to the stationary hub,
said second rotatable collar affixed to said shaft proximate said second hub end,
said shaft and said collar rotatable as a unit with respect to said stationary hub;
first and second spring coils,
each said spring having a first and second end,
said first spring coil positioned to overlap and grip said first collar and said first hub end,
said second spring coil positioned to overlap and grip said second collar and said second hub end,
said first and second spring coils being progressively releasable so as to enable relative rotation of said rotatable collars and thereby said shaft, with respect to said stationary hub;
a first and second drum,
said first drum rotatably overlapping said first spring coil,
said second drum rotatably overlapping said second spring coil,
each said drum including means to engage one said second spring end whereby said drum may be rotated to partially uncoil said spring coil,
each said drum having an upstanding peg formed thereon;
a link arm having a first and second end,
said link arm rotatably mounted proximate said stationary hub intermediate said drums;
a bearing sleeve interposed between said stationary hub and said shaft,
said bearing sleeve surrounding and attached to said shaft;
an arm mount having a first end and a second end,
said first end of said arm mount having rotatably attached to it, said link arm,
said second end of said arm mount passing through said slot in said stationary hub and attaching to said bearing sleeve,
said first end of said link arm being attached to a control arm pivotally attached to said link arm,
said link arm contacts one said peg at its first end,
said link arm contacts the remaining peg intermediate said first and second ends,
said control arm linearly movable to rotate said drums to contact said peg thereby partially uncoiling both of said spring coils and allowing said shaft to rotate with respect to said stationary hub.

10. Table apparatus of the type adjustably maintaining said table in a selected attitude of rotation, said apparatus comprising:

a stationary central hub,
said stationary central hub having a slot formed therethrough,
a shaft,
said stationary hub surrounding said shaft,
said shaft rotatable with respect to said stationary hub,
said stationary hub having a first end and a second end as viewed along the axis of said shaft;
first and second rotatable collars extending about the periphery of said shaft,
said first rotatable collar affixed to said shaft proximate said first hub end,
said shaft and said first collar rotatable as a unit with respect to the stationary hub,
said second rotatable collar affixed to said shaft proximate said second hub end,
said shaft and said second collar rotatable as a unit with respect to said stationary hub;
first and second spring coils,
each said spring having first and second ends,
said first spring coil positioned to overlap and grip said first collar and said first hub end,
said second spring coil positioned to overlap and grip said second collar and said second hub end,
said first and second spring coils being progressively releasable so as to enable relative rotation of said rotatable collars and thereby said shaft, with respect to said stationary hub;
first and second drums,
said first drum rotatably overlapping said first spring coil,
said second drum rotatably overlapping said second spring coil,
each said drum including means to engage one said second spring end whereby said drum may be rotated to partially uncoil said spring coil,
each said drum having an upstanding peg formed thereon;
a link arm having a first and second end,
said link arm rotatably mounted proximate said stationary hub intermediate said drums;
a bearing sleeve interposed between said central hub and said shaft,
said bearing sleeve surrounding and attached to said shaft;
an arm mount having a first end and a second end,
said first end of said arm mount having rotatably attached to it, said link arm,
said second end of said arm mount passing through said slot in said stationary hub and attaching to said bearing sleeve,
said first end of said link arm being attached to a control arm pivotally attached to said link arm,
said link arm contacts one said peg at its second end,
said link arm contacts the remaining peg intermediate said first and second ends,
said control arm linearly movable to rotate said drums to contact said peg thereby partially uncoiling both of said spring coils and allowing said shaft to rotate with respect to said stationary hub;
a support channel member,
said support channel member positioned substantially parallel to said shaft,
said support channel member being operably affixed to said stationary hub and said shaft;
a bracket positioned substantially perpendicular to said shaft,
said bracket operably affixed to said shaft and supporting said control arm;
said table having a top and bottom, said table positioned upon and attached to said bracket, said bottom of said table being positioned above said shaft, said control arm, said link arm, said drums, said stationary hub and said support channel;

said table, said bracket, said control arm, said link arm, said arm mount and said shaft rotatable as a unit with respect to said stationary hub.

* * * * *

UNITED STATES PATENT AND TRADEMARK OFFICE

CERTIFICATE OF CORRECTION

PATENT NO. : 4,278,032

DATED : July 14, 1981

INVENTOR(S) : Victor J. Kritske

It is certified that error appears in the above-identified patent and that said Letters Patent are hereby corrected as shown below:

Col. 3, line 53: "clutch" should be --brake--;

Col. 4, line 19: "clutch" should be --brake--;

Col. 4, line 32: "clutch" should be --brake--.

Signed and Sealed this

*Thirteenth* Day of *October 1981*

[SEAL]

*Attest:*

GERALD J. MOSSINGHOFF

*Attesting Officer*

*Commissioner of Patents and Trademarks*